United States Patent [19]

Godfrey et al.

[11] 3,963,275

[45] June 15, 1976

[54] METHOD OF BREAKING FREE-STANDING ROCK BOULDERS

[75] Inventors: Charles S. Godfrey, Berkeley; John D. Watson, San Leandro, both of Calif.

[73] Assignee: Physics International Company, San Leandro, Calif.

[22] Filed: Dec. 11, 1974

[21] Appl. No.: 531,730

Related U.S. Application Data

[63] Continuation-in-part of Ser. No. 329,615, Feb. 5, 1973, abandoned.

[52] U.S. Cl. ..... 299/13; 89/1 C; 102/23; 175/4.5; 241/27; 241/30

[51] Int. Cl.[2] ..... E21C 37/00

[58] Field of Search ..... 241/1, 27, 30; 299/13; 175/4.5; 102/21, 22; 73/12; 89/1 R, 1 C

[56] References Cited

UNITED STATES PATENTS

| | | | |
|---|---|---|---|
| 3,404,847 | 10/1968 | Smith | 241/27 X |
| 3,695,715 | 10/1972 | Godfrey | 299/13 |

OTHER PUBLICATIONS

"High Velocity Impact in Comminution", Mining Engineering, Oct. 1956, pp. 1028–1032.

*Primary Examiner*—Ernest R. Purser
*Attorney, Agent, or Firm*—Lindenberg, Freilich, Wasserman, Rosen & Fernandez

[57] ABSTRACT

Free-standing boulders or rocks are fractured and broken down into many smaller pieces by impacting the boulder with a high velocity projectile. The impact energy is delivered to the rock by a blunt nosed projectile in a time which is less than the transit time of a sound signal across the average diameter of the rock.

9 Claims, 3 Drawing Figures

METHOD OF BREAKING FREE-STANDING ROCK BOULDERS

This application is a continuation-in-part of application Ser. No. 329,615, filed Feb. 5, 1973 now abandoned.

BACKGROUND OF THE INVENTION

This invention relates to a method and means for breaking up free-standing boulders, and more particularly, to improvements therein.

In open pit mines, charges of explosive are used to break out in-situ formations of ore breaking rock. The resultant debris is fed into crushers, and eventually processed to remove the desirable ore. A normal consequence of the primary explosion blasting is a distribution of fragment sizes ranging from small rocks to very large boulders. Boulders weighing several tens of tons are typical of the upper sizes obtained. These large boulders are often too large to be moved by vehicles or to fit into the rock crushing apparatus. It is necessary therefore, to break them into smaller fragments. Several schemes are conventionally employed for this purpose. Most commonly a drill rig such as a jackhammer is brought to the boulder and used to drill a bore hole. Explosive is placed in the hole. The crew and drill rig are removed, and the charge is remotely fired. From an energy point of view, this is an efficient process. From a point of view of labor, cost and safety, however, it is very poor. It is often both difficult and unsafe to approach the boulder with personnel and drill rig. It might for example, be surrounded by other boulders or be supported in an unstable manner, such that a small perturbation will make it move suddenly. Because the explosive charges are buried in the rock, the expansion of hot detonation products is very effective in accelerating fragments or rock and propelling them for large distances. This means that equipment and personnel must be removed for large distances before firing, resulting in a very inefficient use of personnel and equipment.

Mud capping is another technique employed. Here, no drill is required. Explosive is placed on the outside of the boulder and tamped with earth or mud. There are also explosive rock breakers which act similarly. These devices are all quite inefficient in the use of explosive. They create a high intensity blast wave. High velocity fragments are still a problem. Also, personnel must still approach and mount the boulder in order to emplace the charges.

Still another technique in fracturing boulders is the use of a large metal ball or swing ball hanging from a crane arm. The crane arm is moved in a manner so that the ball impacts the boulder and fractures it. This technique is often used in quarries, where the boulders are not too large and access to them is straightforward. In a large open pit operation however, the crane cannot always get close enough to the boulders to perform its function.

In quarries, and along mountainous highways, railways, or other thoroughfares, particularly those cut through rock, there are often places where overhanging or loose boulders pose a safety problem. To reach them, in order to employ the above rock breaking schemes is extremely hazardous.

OBJECTS AND SUMMARY OF THE INVENTION

An object of this invention is to provide a means for breaking large rock boulders remotely without having to approach the boulder with either personnel or equipment.

Another object of this invention is to provide a method and means for breaking a boulder into fragments in such a way that no fragments are propelled large distances from the boulder.

Yet another object of this invention is to provide a more efficient, safer, and less costly method and means for breaking free standing boulders.

These and other objects of the invention may be achieved by shooting a blunt nosed projectile against a free-standing rock with a velocity such that the energy of the projectile is released into the rock in a time that is small when compared with the transit time of a sound signal through that rock. The unexpected result achieved is that the free-standing rock shatters into fragments, with cracks in the rocks originating at the free surfaces thereof. By a free-standing rock or boulder is meant that the rock or boulder is an individual body, not a part of other formations, which has all of its surface area exposed, aside from that portion by which the boulder or rock is supported. When a projectile is impacted against the rock face of a mine or other situation where the rock is not free-standing, the rock face is cratered, and pieces break off around a hemispherical region centered on the point of contact. This material consists of relatively small fragments which have been crushed by the compressive stress waves created by impact of the projectile. The other half of the material coming from the outer periphery of the crater comprises fairly large fragments which have spalled off the front face. Concrete projectiles of 10 pounds mass impacting a solid face of granite (having an unconfined compressive strength of 25,000 psi) at 5,000 ft. per second, were found to break out a mass of 1,000 to 1,100 pounds of rock. Crater dimensions were 12 inches deep and 50 inches in diameter. When a similar projectile impacts a large free-standing boulder, it will make a similar crater. However, there is an important difference, which does not take place in in-situ rock. This important difference is that the entire free-standing boulder is fragmented.

DESCRIPTION OF THE PREFERRED EMBODIMENTS

Figure 1:
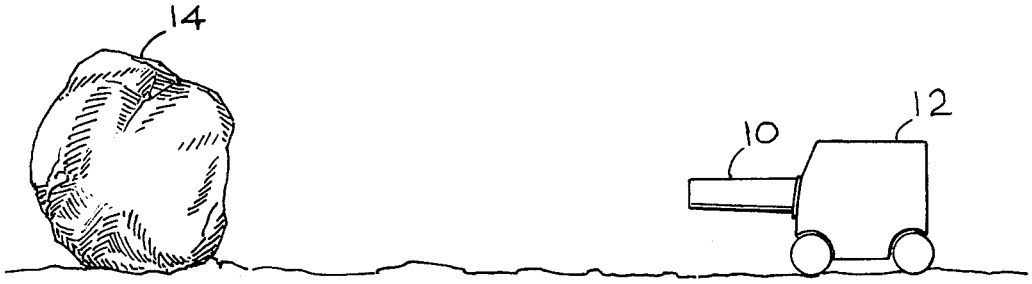
FIG. 1 is a schematic drawing of the invention.

FIG. 1 schematically represents the method of practicing this invention. A gun 10, which is supported by a movable vehicle 12, is used to fire projectiles at a high velocity against a free-standing rock 14. The vehicle 12, together with the gun or cannon, may be of the type which is described in U.S. Pat. No. 3,695,715. It may either be self-propelled or track drawn as desired. It is moved to a location where it is within range of the free-standing boulder which is to be fractured and broken up. The projectile which is to be used may also be of the type which is described in U.S. Pat. No.

3,695,715, has a blunt nose, and may be made of a material such as concrete, which has a large mass, but which is frangible upon impact.

The projectile should ideally be hit nearly normal to the impact surface, but can be as much as 30° off normal without too much loss of efficiency. Projectiles will be subject to a compressive stress of roughly 1 million psi on impact. A concrete projectile will obviously shatter into dust under these conditions. Fragments from the shattered concrete projectiles will not go very far in air, they are so small that the air drag quickly stops them. Metal projectiles, on the other hand, are found to deform plastically and break up into fragments which are large enough to go considerable distances (as a rifle bullet). Thus, while metal projectiles may be used, it is safer to use frangible projectiles such as concrete instead of metal.

Concrete projectiles have been fired at a distance of 150 feet without breaking up or deflecting appreciably from their line of sight trajectory. A vehicle can fragment all the boulders within the radius of its line of sight.

Figure 2:
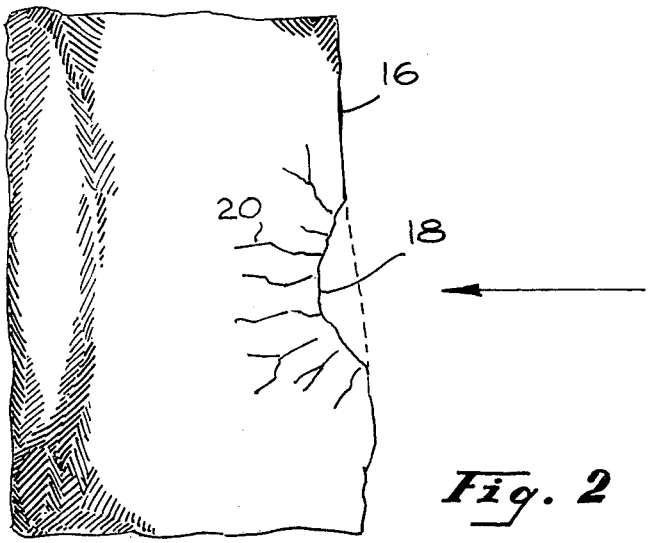
FIG. 2 is a side view representing the rock face which has been impacted by a projectile, where the rock is not free-standing.
Figure 3:
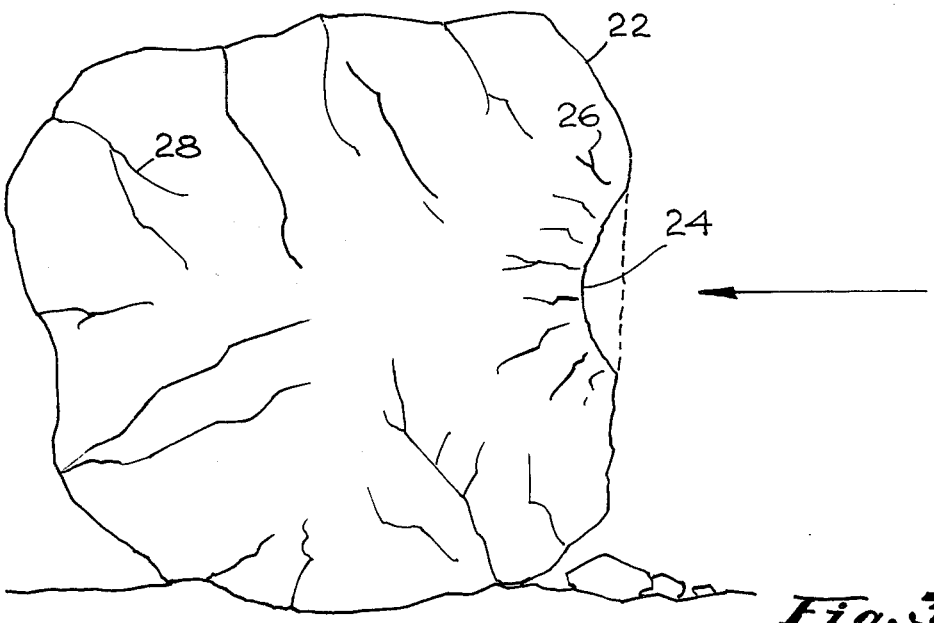
FIG. 3 is a representation of a free-standing boulder after impact by a projectile.

FIG. 2 is a cross-sectional view of a semi-infinite rock face after it has been struck by a projectile. The rock face 16 has a crater 18 therein as a result of being impacted by the projectile. Cracks, such as 20, radiate from the crater region.

Contrast the foregoing with the appearance of a free-standing rock or boulder after it has been impacted by a projectile. The boulder 22 similarly has a crater 24, with cracks, such as 26, radiating from the crater. However, additionally, there are numerous cracks, such as 28, which radiate from the free surfaces of the boulder, and which determine the number of fragments into which the boulder is integrated.

The unlooked for and unexpected result which is achieved by this invention is the creation of these cracks radiating from the free surfaces which effectively result in fragmenting the entire boulder. This effect does not take place for in-situ rock since it does not have any free surfaces. This effect is completely due to internal reflection of the stress wave when it reaches the free surface of the boulder.

By way of an explanation of the new and unexpected result obtained, a most effective way (from an energy point of view), to break a large free-standing boulder is to release energy suddenly at its center. This is how boulders are often fractured. A rock drill is used to drill a hole, explosive is then inserted into the hole and tamped. When the explosive is detonated, it releases its energy suddenly and the boulder is fractured. By "suddenly" is meant that the energy is released in a time that is small with respect to the time it takes a sound signal to go from the center of the boulder to its outside surface and back (i.e., to travel one diameter). The reasoning is as follows: when the energy is released, a spherical compression wave diverges from the source. When it reaches the outer surface of the boulder, it is reflected as a tensile wave. This tensile wave converges back on the source. The magnitude of a converging spherical tensile wave becomes very large as it approaches the center. This "in phase" tensile wave is the main factor responsible for the efficient breaking of the boulder. If the energy were released in a time comparable to (or greater than) the transit time of the wave, it is clear that the resulting wave would be stretched out in time and reduced in amplitude. Various regions of the wave would also be out of phase with each other. Ingoing tensile waves for example, would interact with outgoing compression waves and result in even lower amplitude stresses. For this case, it is clear, therefore, that the energy should be released in a time that is small with respect to the transit time of a sound signal across the diameter of the boulder.

As indicated above, a most effective way to break a boulder is to release energy at its center. However, this is not the most economical way. The cost and time of drilling a hole are substantial. If the energy is deposited on the outside surface of the boulder more energy is required, but one does not have to drill a hole. Although the geometry is quite different, the same arguments relating to the time in which this energy is transferred are also applicable to this case. Again, it is a matter of amplitude and phasing. As mentioned above, the more rapid is the release of energy, the larger will be the amplitude of the wave. Moreover, if the energy is released in a time much less than the transit time of a sound signal across the diameter of the boulder, the compression waves will reflect from the surface as tensile waves which will tend to focus somewhere in the interior of the boulder (depending on the specific geometry of the boulder). The focusing of these waves combined with their large amplitude makes the technique of impact by a high velocity projectile an effective way of fracturing large free standing boulders.

It is known that an elastic compressive stress wave impinging on a free surface, will reflect from that surface as a tensile wave and a shear wave. The impact of the projectile on the surface of the free standing boulder creates compressive stress waves which diverge from the point of impact. These stress waves are reflected from the surface of the boulder as tensile waves and shear waves. The reconvergence of the tensile waves and shear waves in the interior of the boulder produces sufficient tensile stress and shear stress to exceed the strength of the boulder. The boulder normally splits into several medium size fragments and some smaller ones. Stress waves can overcome the strength of the rock, but they do not accelerate fragments to high velocity. The fragments, therefore, do not create a hazard to nearby equipment.

By way of illustration of the specifics involved, consider the breakage of a free standing boulder by impact of a high speed blunt projectile. Consider first the energy transfer process. To simplify the example, assume a one-caliber granite cylinder approximately 10 lbs. weight impacting a 40 ton granite boulder. The projectile has a diameter and length of approximately 5 inches. The boulder has a diameter of roughly 5 feet. A typical granite might have a sound speed (Cp) of 15,000 ft/sec. The example to be used will require that the impact stress be much greater than the compressive strength of granite. If this is true, the strength of the granite projectile will play essentially no role in the process. At an impact velocity of approximately 5,000 ft/sec, the impact stress is roughly 120 kilobars or 1,750,000 psi. This certainly meets the above criteria for not only granite, but also a steel projectile. For granite impacting granite, the velocity of the interface will move at half the velocity of the projectile. A plane shock will move into the boulder and a plane shock will run to the back end of the projectile. The time for the shock wave to get to the back end of the projectile is somewhat less than the time for a sound signal, but for this example assume them to be equal. This time would be $$\frac{\frac{5}{12}\text{ft}}{15{,}000\text{ ft/sec}}$$

or 28μsec. At this time approximately half the energy of the projectile would have been transferred to the boulder. Roughly half of the energy in the boulder would be in the kinetic energy of the shock wave and half in internal (compression) energy. It would take the leading edge of the reflected tensile wave another 28μsec to get back to the projectile-boulder interface, and perhaps another 40μsec for the stress at the interface to drop to a small value. By this time (i.e., approximately 100μsec) the transfer of energy would be largely complete. A small amount of kinetic and internal energy would be left in the projectile (enough to blow it apart), but the majority of its energy would have been transferred to the boulder. The time for a sound signal to traverse one diameter of the boulder is 5 ft/15,000 ft/sec or 333μsec, or at least 3 times greater than the energy transfer time.

The example presented above assumes a plane impact. If the projectile hit at some angle, or if it were spherical instead of cylindrical, the timing of the energy transfer would not be significantly changed. The above example also assumes that the projectile and the boulder are composed of the same material. If the impedance (Cp times the density) of the projectile were less than that of the boulder (i.e., concrete) or greater than that of the boulder (i.e., steel), the time to transfer the energy would be slightly greater and the amount of energy transferred (assuming the same mass and velocity projectile) would be slightly less. These differences, however, do not affect the basic arguments presented herein.

As proof of the foregoing it was found that a 10 pound concrete projectile impacting at 5,000 ft. per second fragmented 10 to 30 ton boulders with one shot. A 40 ton boulder took two impacts to fragment. By way of contrast, concrete projectiles of 10 pound mass impacting a solid face of granite (not free-standing and having an unconfined compressive strength of 25,000 psi) at 5,000 ft. per second, were found to break out a mass of 1,000 to 1,100 pounds of rock. Crater dimensions were 12 inches deep and 50 inches in diameter. Compare this 1,000 pound crater breakage for a rock face of large area with the fragmentation of a 60,000 pound free standing boulder. The two processes are obviously different. In the case of the rock face, the stress waves diverging from the point of impact do not impinge on a free surface, and hence, are not reflected back toward the point of impact as tensile or shear waves.

As pointed out previously, concrete projectiles have been fired at distances of 150 ft. without breaking up or deflecting appreciably from their line of sight trajectory, thus providing a means for fragmenting all boulders within the 150 ft. radius. It is possible that such projectiles can be designed to have ranges substantially greater than this.

Therefore, in accordance with this invention, from a knowledge of the speed of sound through a boulder to be broken up, either obtained from a handbook, or measured, and from a measurement of the approximate diameter of the free-standing boulder, the time for a sound signal to traverse one diameter of the boulder can be calculated by dividing the diameter by the speed of sound. The impacting projectile should transfer its energy to the boulder within an interval at most equal to, but preferably very much less than, the time for a sound signal to traverse one diameter of the boulder. The velocity required for the impacting projectile to transfer its energy to insure breakage of the boulder is then readily calculated.

In principle, a different threshold velocity and projectile mass would exist for different sizes and different types of boulders, requiring changing cannon size, projectile mass and/or changing charge loads. Manifestly this is not a good or practical solution to the problem of breaking boulders. It is better to use the same charge and a single cannon if possible as long as the impact velocity and mass are adequate for the particular job to be performed.

It has been found that a 10 lb. concrete or granite blunt nosed projectile with a diameter and length of 5 inches, which is fired to impact at a velocity of 5000 ft/sec, provides an energy transfer time in excess of that required for most if not all boulders. As indicated above, 10 to 30 ton boulders were fragmented with one shot. A 40 ton boulder took two shots.

There has accordingly been described and shown a novel, useful and improved method and means for breaking free-standing boulders.

What is claimed is:

1. The method of fragmenting a free-standing boulder comprising determining the average diameter of said boulder to determine the time required for sound to traverse said average diameter determining the compressive strength of said boulder, selecting a projectile having a mass which will establish an impact stress within said boulder greater than the compressive strength of the boulder, when impacted upon said boulder with a velocity which causes an energy transfer to said boulder within a time less than said determined time, loading said cannon with said selected projectile, loading said cannon with a charge which when detonated will cause said projectile to impact upon said boulder with said velocity, aiming said cannon at said boulder, and detonating said charge.

2. The method as recited in claim 1 wherein said projectile is frangible.

3. The method as recited in claim 1 wherein said projectile impacts said boulder with a compressive stress on the order of 1.0 million psi.

4. The method as recited in claim 1 wherein said projectile has a blunt nose.

5. The method as recited in claim 4 wherein the angle of impact between said boulder and said projectile is less than 30° with the normal to the face of the boulder.

6. The method as recited in claim 1 wherein the impact velocity of said projectile is on the order of 5000 ft/sec.

7. The method as recited in claim 6 wherein said projectile has a weight on the order of 10 pounds and has a diameter and length on the order of 5 inches.

8. The method as recited in claim 7 wherein said projectile is made out of concrete.

9. The method of fragmenting a free-standing boulder comprising selecting a projectile having a mass on the order of 10 pounds, and a diameter and length on the order of 5 inches, loading a cannon with said projectile, loading said cannon with a charge which, when detonated causes said projectile to impact said boulder with a velocity on the order of 5000 ft/sec., aiming said cannon at said boulder, detonating said charge to apply a compressive stress to said boulder by said projectile when it impacts, which exceeds the compressive strength of said boulder.

* * * * *